US009335077B2

(12) United States Patent
Hanafusa

(10) Patent No.: US 9,335,077 B2
(45) Date of Patent: May 10, 2016

(54) CONDENSER WITH FIRST HEADER TANK AND SECOND HEADER TANK PROVIDED ON ONE SIDE OF THE CONDENSER

(75) Inventor: Tatsuya Hanafusa, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 805 days.

(21) Appl. No.: 12/736,875

(22) PCT Filed: Oct. 20, 2009

(86) PCT No.: PCT/JP2009/068050

§ 371 (c)(1),
(2), (4) Date: Nov. 18, 2010

(87) PCT Pub. No.: WO2010/047320

PCT Pub. Date: Apr. 29, 2010

(65) Prior Publication Data

US 2011/0186277 A1 Aug. 4, 2011

(30) Foreign Application Priority Data

Oct. 20, 2008 (JP) ..... 2008-269505

(51) Int. Cl.
*F28B 1/00* (2006.01)
*F25B 39/04* (2006.01)
(Continued)

(52) U.S. Cl.
CPC ..... *F25B 39/04* (2013.01); *F28D 1/05375* (2013.01); *F28F 9/02* (2013.01);
(Continued)

(58) Field of Classification Search
CPC ..... F28F 9/02; F28F 1/00; F25B 39/04; F25B 40/02; F25B 2339/044; F25B 2339/0446; F25B 2339/0441; F28D 1/05375; F28D 2021/0084
USPC ..... 62/509; 165/148, 150, 151, 153, 172, 165/173, 174, 175, 176, 178
See application file for complete search history.

(56) References Cited

U.S. PATENT DOCUMENTS 2,004,390 A * 6/1935 Benzinger ..... 165/71
4,936,379 A * 6/1990 Hoshino et al. ..... 165/153
(Continued)

FOREIGN PATENT DOCUMENTS

FR 2747768 A1 * 10/1997 ..... F25B 39/04
JP 3-31266 U 3/1991
(Continued)

OTHER PUBLICATIONS

Machine translation of description of FR-2747768; retreived from www.espace.net on Mar. 2015.*
(Continued)

*Primary Examiner* — Orlando Aviles Bosques
(74) *Attorney, Agent, or Firm* — Mori & Ward, LLP

(57) ABSTRACT

A condenser includes a first header tank which is provided on one side of the condenser, a second header tank which is provided on the one side of the condenser and which has a gas-liquid separation function, and a third header tank provided on another side of the condenser opposite to the one side. First heat exchange tubes extend in an extending direction between the first header tank and the third header tank to connect the first header tank and the third header tank. Second heat exchange tubes are provided below the first heat exchange tubes and extend in the extending direction between the second header tank and the third header tank to connect the second header tank and the third header tank. The second heat exchange tubes are longer than the first heat exchange tubes in the extending direction.

17 Claims, 10 Drawing Sheets

(51) Int. Cl.

| | |
|---|---|
| ***F28F 9/02*** | (2006.01) |
| ***F28D 1/053*** | (2006.01) |
| *F28F 1/00* | (2006.01) |
| *F25B 40/02* | (2006.01) |
| *F28D 21/00* | (2006.01) |

(52) U.S. Cl.

CPC ..... *F25B 40/02* (2013.01); *F25B 2339/044* (2013.01); *F25B 2339/0441* (2013.01); *F25B 2339/0446* (2013.01); *F25B 2500/01* (2013.01); *F28D 2021/0084* (2013.01); *F28F 1/00* (2013.01)

(56) References Cited

U.S. PATENT DOCUMENTS

| | | | | | |
|---|---|---|---|---|---|
| 4,972,683 | A | * | 11/1990 | Beatenbough | 62/507 |
| 4,977,956 | A | * | 12/1990 | Aoki et al. | 165/176 |
| 5,033,539 | A | * | 7/1991 | Kohtaka | 165/104.14 |
| 5,168,925 | A | * | 12/1992 | Suzumura et al. | 165/174 |
| 5,546,761 | A | * | 8/1996 | Matsuo et al. | 165/173 |
| 6,810,949 | B1 | * | 11/2004 | Staffa et al. | 165/135 |
| 2002/0124593 | A1 | * | 9/2002 | Yamazaki et al. | 62/509 |
| 2005/0217831 | A1 | * | 10/2005 | Manaka | 165/140 |

FOREIGN PATENT DOCUMENTS

| | | | |
|---|---|---|---|
| JP | 11-316065 | A | 11/1999 |
| JP | 2001-141332 | A | 5/2001 |
| JP | 2002-286393 | A | 10/2002 |
| JP | 2003-106708 | A | 4/2003 |
| JP | 2005-106409 | A | 4/2005 |

OTHER PUBLICATIONS

International Search Report for International Application No. PCT/JP2009/068050 dated Dec. 8, 2009.

Written Opinion of the International Searching Authority for International Application No. PCT/JP2009/068050 dated Dec. 8, 2009.

* cited by examiner

CONDENSER WITH FIRST HEADER TANK AND SECOND HEADER TANK PROVIDED ON ONE SIDE OF THE CONDENSER

TECHNICAL FIELD

The present invention relates to a condenser suitable for use in, for example, a car air conditioner mounted on an automobile.

Herein and in the appended claims, the term "condenser" encompasses not only ordinary condensers but also sub-cool condensers each including a condensation section and a super-cooling section.

Further, herein and in the appended claims, the upper side, lower side, left-hand side, and right-hand side of FIGS. 1 and 3 will be referred to as "upper," "lower," "left," and "right," respectively.

BACKGROUND ART

A condenser for a car air conditioner is known (see Patent Document 1). The known condenser includes a plurality of heat exchange tubes disposed in parallel such that they are spaced apart from one another in a vertical direction and extend in a left-right direction; left and right header tanks which are disposed such that they extend in the vertical direction and are spaced apart from each other in the left-right direction and to which opposite ends of the heat exchange tubes are connected by means of brazing; and a liquid receiver brazed to one header tank. Two heat exchange paths each formed by a plurality of heat exchange tubes successively arranged in the vertical direction are juxtaposed in the vertical direction. The interiors of the two header tanks are divided by respective partition members at a height between the two heat exchange paths, whereby two header sections; i.e., upper and lower header sections, are formed in each of the two header tanks. The heat exchange tubes which constitute the upper heat exchange path are connected to the upper header sections of the two header tanks, and the heat exchange tubes which constitute the lower heat exchange path are connected to the lower header sections of the two header tanks. The liquid receiver is brazed to the one header tank such that the liquid receiver extends across the upper and lower header sections. The liquid receiver has an inflow hole communicating with the interior of the upper header section of the one header tank, and an outflow hole communicating with the interior of the lower header section thereof. The other header tank has a refrigerant inlet communicating with a lower portion of the interior of the upper header section, and a refrigerant outlet communicating with a vertically intermediate portion of the interior of the lower header section. The upper header sections of the two header tanks and the upper heat exchange path form a condensation section which condensates refrigerant. The lower header sections of the two header tanks and the lower heat exchange path form a super-cooling section which super-cools the refrigerant. The upper heat exchange path serves as a refrigerant condensation path for condensing the refrigerant, and the lower heat exchange path serves as a refrigerant super-cooling path for super-cooling the refrigerant.

However, in the case of the condenser disclosed in Patent Document 1, in addition to brazing between the header tanks and the heat exchange tubes, brazing between one of the header tanks and the liquid receiver is required. Therefore, the number of brazing areas increases, resulting in an increased possibility of occurrence of leakage. In addition, in the case of the condenser disclosed in Patent Document 1, since the condensation section includes only one heat exchange path, the condenser has a problem of failing to satisfy the required condensation performance.

PRIOR ART DOCUMENT

Patent Document

Patent Document 1: Japanese Patent Application Laid-Open (kokai) No. 2001-141332

SUMMARY OF THE INVENTION

Problems to be Solved by the Invention

An object of the present invention is to solve the above problem and to provide a condenser which can reduce the number of brazing areas as compared with the condenser disclosed in Patent Document 1 and can improve condensation performance.

Means for Solving the Problems

To achieve the above object, the present invention comprises the following modes.

1) A condenser comprising a plurality of heat exchange tubes disposed in parallel such that the heat exchange tubes are spaced apart from one another in a vertical direction and extend in a left-right direction; and header tanks which extend in the vertical direction and to which left and right end portions of the heat exchange tubes are connected, in which three or more heat exchange paths each formed by a plurality of heat exchange tubes successively arranged in the vertical direction are juxtaposed in the vertical direction, refrigerant flows in the same direction within all the heat exchange tubes which constitute each heat exchange path, and the flow direction of the refrigerant within the heat exchange tubes which constitute a certain heat exchange path is opposite the flow direction of the refrigerant within the heat exchange tubes which constitute another heat exchange path adjacent to the certain heat exchange path, wherein a first header tank and a second header tank are separately provided at a left end portion or right end portion of the condenser; heat exchange tubes which constitute at least an uppermost heat exchange path are connected to the first header tank; heat exchange tubes which constitute a heat exchange path(s) provided below the heat exchange path formed by the heat exchange tubes connected to the first header tank are connected to the second header tank; the first header tank and the second header tank are positionally shifted from each other as viewed from above; an upper end of the second header tank is located above a lower end of the first header tank; and the second header tank has a gas-liquid separation function making use of gravitational force.

2) A condenser according to par. 1), wherein the heat exchange path formed by the heat exchange tubes connected to the first header tank and the uppermost heat exchange path of the heat exchange paths formed by the heat exchange tubes connected to the second header tank each serve as a refrigerant condensation path for condensing the refrigerant; and the heat exchange path(s) formed by the heat exchange tubes connected to the second header tank, excluding the uppermost heat exchange path, serves as a refrigerant super-cooling path for super-cooling the refrigerant.

3) A condenser according to par. 1) or 2), wherein at least one of a desiccant, a gas-liquid separation member, and a filter is disposed within the second header tank.

4) A condenser according to par. 1) or 2), wherein heat exchange tubes which constitute at least one heat exchange path are connected to the first header tank; and heat exchange tubes which constitute at least two heat exchange paths are connected to the second header tank.

5) A condenser comprising a plurality of heat exchange tubes disposed in parallel such that the heat exchange tubes are spaced apart from one another in a vertical direction; and header tanks which extend in the vertical direction and to which left and right end portions of the heat exchange tubes are connected, in which two or more heat exchange paths each formed by a plurality of heat exchange tubes successively arranged in the vertical direction are juxtaposed in the vertical direction, refrigerant flows in the same direction within all the heat exchange tubes which constitute each heat exchange path, and the flow direction of the refrigerant within the heat exchange tubes which constitute a certain heat exchange path is opposite the flow direction of the refrigerant within the heat exchange tubes which constitute another heat exchange path adjacent to the certain heat exchange path, wherein a first header tank and a second header tank are separately provided at a left end portion or right end portion of the condenser; heat exchange tubes which constitute a heat exchange path(s) excluding a lowermost heat exchange path are connected to the first header tank; heat exchange tubes which constitute the lowermost heat exchange path are connected to the second header tank; the first header tank and the second header tank are positionally shifted from each other as viewed from above; and an upper end of the second header tank is located above a lower end of the first header tank.

6) A condenser comprising a plurality of heat exchange tubes disposed in parallel such that the heat exchange tubes are spaced apart from one another in a vertical direction; and header tanks which extend in the vertical direction and to which left and right end portions of the heat exchange tubes are connected, in which two or more heat exchange paths each formed by a plurality of heat exchange tubes successively arranged in the vertical direction are juxtaposed in the vertical direction, refrigerant flows in the same direction within all the heat exchange tubes which constitute each heat exchange path, and the flow direction of the refrigerant within the heat exchange tubes which constitute a certain heat exchange path is opposite the flow direction of the refrigerant within the heat exchange tubes which constitute another heat exchange path adjacent to the certain heat exchange path, wherein a first header tank and a second header tank are separately provided at a left end portion or right end portion of the condenser; heat exchange tubes which constitute a heat exchange path(s) excluding an uppermost heat exchange path are connected to the first header tank; heat exchange tubes which constitute the uppermost heat exchange path are connected to the second header tank; the first header tank and the second header tank are positionally shifted from each other as viewed from above; and a lower end of the second header tank is located below an upper end of the first header tank.

7) A condenser according to par. 5) or 6), wherein each of all the heat exchange paths serves as a refrigerant condensation path for condensing the refrigerant.

8) A condenser according to par. 5) or 6), wherein at least one of a desiccant, a gas-liquid separation member, and a filter is disposed within the second header tank.

9) A condenser according to par. 1), 5), or 6), wherein the second header tank is disposed on the outer side of the first header tank with respect to the left-right direction; all the heat exchange tubes are straight; second-header-tank-side end portions of the heat exchange tubes connected to the second header tank extend outward with respect to the left-right direction beyond first-header-tank-side end portions of the heat exchange tubes connected to the first header tank.

10) A condenser according to par. 1), 5), or 6), wherein the second header tank is positionally shifted from the first header tank in an air-passing direction; second-header-tank-side end portions of the heat exchange tubes connected to the second header tank are bent; and a bent portion of each bent heat exchange tube is located in the same plane as the remaining unbent portion of the heat exchange tube.

11) A condenser according to par. 1), 5), or 6), wherein the second header tank is positionally shifted from the first header tank in an air-passing direction; second-header-tank-side end portions of the heat exchange tubes connected to the second header tank are bent in a folded back shape; and a bent portion of each bent heat exchange tube is located in a plane shifted from a plane in which the remaining unbent portion of the heat exchange tube is located.

12) A condenser according to par. 1), 5), or 6), wherein the second header tank is positionally shifted from the first header tank in an air-passing direction; first-header-tank-side end portions of the heat exchange tubes connected to the first header tank and second-header-tank-side end portions of the heat exchange tubes connected to the second header tank are bent; and a bent portion of each bent heat exchange tube is located in the same plane as the remaining unbent portion of the heat exchange tube.

Effect of the Invention

According to the condensers of pars. 1) to 4), a first header tank and a second header tank are separately provided at a left end portion or right end portion of the condenser; heat exchange tubes which constitute at least an uppermost heat exchange path are connected to the first header tank; heat exchange tubes which constitute a heat exchange path(s) provided below the heat exchange path formed by the heat exchange tubes connected to the first header tank are connected to the second header tank; the first header tank and the second header tank are positionally shifted from each other as viewed from above; an upper end of the second header tank is located above a lower end of the first header tank; and the second header tank has a gas-liquid separation function making use of gravitational force. Therefore, a liquid receiver used in the condenser described in Patent Document 1 is not required, and brazing between the liquid receiver and the corresponding header tank becomes unnecessary. Accordingly, the number of brazing areas decreases as compared with the condenser described in Patent Document 1, and the possibility of occurrence of leakage decreases. Furthermore, since two or more refrigerant condensation paths for condensing refrigerant can be provided, condensing performance can be improved.

According to the condenser of par. 2), refrigerant flows from the plurality of heat exchange tubes which constitute the lowermost refrigerant condensation path into the second header tank, and the refrigerant undergoes gas-liquid separation within the second header tank. Therefore, it is possible to suppress generation of a pressure drop, to thereby prevent re-gasification of the liquid-phase refrigerant. In contrast, in the case of the condenser described in Patent Document 1, the refrigerant having flowed into an upper header section from a plurality of heat exchange tubes which constitute an upper heat exchange path serving as a refrigerant condensation path flows into the liquid receiver via an inflow hole of the liquid receiver. Therefore, a pressure drop is likely to occur when the refrigerant flows into the liquid receiver, and re-gasification of the liquid-phase refrigerant occurs.

Furthermore, according to the condenser of par. 2), refrigerant flows from the plurality of heat exchange tubes which constitute the lowermost refrigerant condensation path into the second header tank, and the refrigerant undergoes gas-liquid separation within the second header tank. Therefore, gas-liquid separation can be performed efficiently within the second header tank. That is, gas-liquid mixed phase refrigerant containing a gas-phase component in a large amount flows through an upper heat exchange tube(s) of the plurality of heat exchange tubes which constitute the refrigerant condensation path, and gas-liquid mixed phase refrigerant containing a liquid-phase component in a large amount flows through a lower heat exchange tube(s) of the plurality of heat exchange tubes. Since these gas-liquid mixed phase refrigerants flow into the second header tank without mixing, gas-liquid separation can be performed efficiently. In contrast, in the case of the condenser described in Patent Document 1, even if gas-liquid mixed phase refrigerant containing a gas-phase component in a large amount flows through an upper heat exchange tube(s) of the plurality of heat exchange tubes which constitute the upper heat exchange path serving as a refrigerant condensation path, and gas-liquid mixed phase refrigerant containing a liquid-phase component in a large amount flows through a lower heat exchange tube(s) of the plurality of heat exchange tubes, these gas-liquid mixed phase refrigerants flow into the liquid receiver after having mixed together within the upper header section. Therefore, gas-liquid separation cannot be performed efficiently.

According to the condenser of par. 5), a first header tank and a second header tank are separately provided at a left end portion or right end portion of the condenser; heat exchange tubes which constitute a heat exchange path(s) excluding a lowermost heat exchange path are connected to the first header tank; heat exchange tubes which constitute the lowermost heat exchange path are connected to the second header tank; the first header tank and the second header tank are positionally shifted from each other as viewed from above; and an upper end of the second header tank is located above a lower end of the first header tank. Therefore, a liquid receiver used in the condenser described in Patent Document 1 is not required, and brazing between the liquid receiver and the corresponding header tank becomes unnecessary. Accordingly, the number of brazing areas decreases as compared with the condenser described in Patent Document 1, and the possibility of occurrence of leakage decreases. Furthermore, since two or more refrigerant condensation paths for condensing refrigerant can be provided, condensing performance can be improved.

Furthermore, refrigerant flows from the plurality of heat exchange tubes which constitute the lowermost refrigerant condensation path into the second header tank, and the refrigerant undergoes gas-liquid separation within the second header tank. Therefore, gas-liquid separation can be performed efficiently within the second header tank. That is, gas-liquid mixed phase refrigerant containing a gas-phase component in a large amount flows through an upper heat exchange tube(s) of the plurality of heat exchange tubes which constitute the lowermost heat exchange path, and gas-liquid mixed phase refrigerant containing a liquid-phase component in a large amount flows through a lower heat exchange tube(s) of the plurality of heat exchange tubes. Since these gas-liquid mixed phase refrigerants flow into the second header tank without mixing, gas-liquid separation can be performed efficiently.

According to the condenser of par. 6), a first header tank and a second header tank are separately provided at a left end portion or right end portion of the condenser; heat exchange tubes which constitute a heat exchange path(s) excluding an uppermost heat exchange path are connected to the first header tank; heat exchange tubes which constitute the uppermost heat exchange path are connected to the second header tank; the first header tank and the second header tank are positionally shifted from each other as viewed from above; and a lower end of the second header tank is located below an upper end of the first header tank. Therefore, a liquid receiver used in the condenser described in Patent Document 1 is not required, and brazing between the liquid receiver and the corresponding header tank becomes unnecessary. Accordingly, the number of brazing areas decreases as compared with the condenser described in Patent Document 1, and the possibility of occurrence of leakage decreases. Furthermore, since two or more refrigerant condensation paths for condensing refrigerant can be provided, condensing performance can be improved.

Furthermore, refrigerant flows from the plurality of heat exchange tubes which constitute the uppermost refrigerant condensation path into the second header tank, and the refrigerant undergoes gas-liquid separation within the second header tank. Therefore, gas-liquid separation can be performed efficiently within the second header tank. That is, gas-liquid mixed phase refrigerant containing a gas-phase component in a large amount flows through an upper heat exchange tube(s) of the plurality of heat exchange tubes which constitute the uppermost heat exchange path, and gas-liquid mixed phase refrigerant containing a liquid-phase component in a large amount flows through a lower heat exchange tube(s) of the plurality of heat exchange tubes. Since these gas-liquid mixed phase refrigerants flow into the second header tank without mixing, gas-liquid separation can be performed efficiently.

According to the condensers of pars. 9) to 12), the first header tank and the second header tank can be relatively easily shifted from each other as viewed from above.

According to the condensers of pars. 10) to 12), even in the case where other equipment must be disposed on the side of the condenser opposite (with respect to the air passing direction) the side where the second header tank is disposed, the second header tank does not hinder the disposition of the equipment. For example, in general, a radiator is disposed on the downstream side (with respect to the air passing direction) of a condenser of a car air conditioner. By means of disposing the second header tank at a location shifted toward the upstream side with respect to the air passing direction, it is possible to prevent the second header tank from hindering the installation of the radiator.

Figure 1:
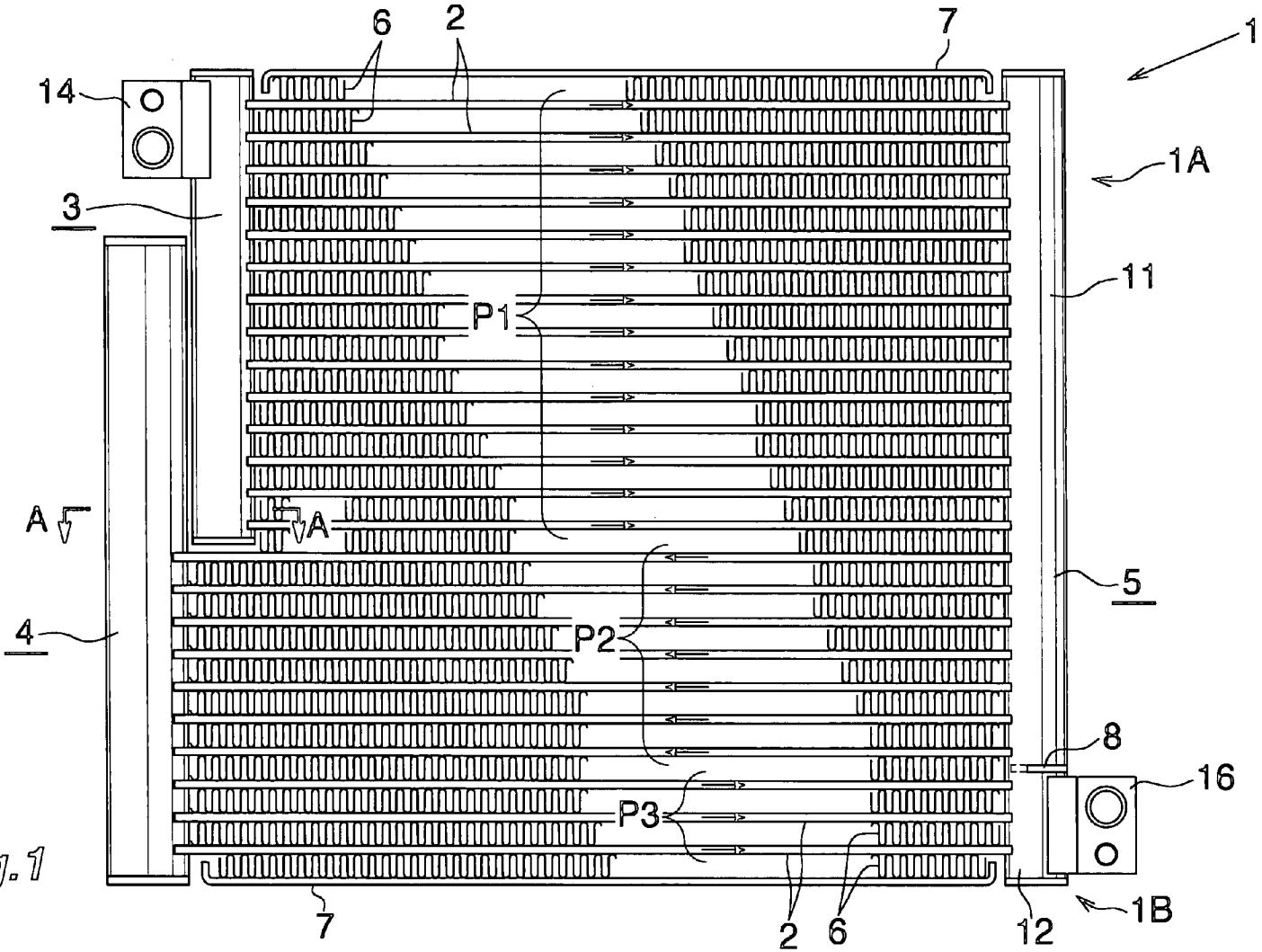
FIG. 1 is a front view specifically showing the overall structure of a first embodiment of the condenser according to the present invention.

DESCRIPTION OF REFERENCE NUMERALS (1), (20), (30), (50), (60), (70), (80), (90): condenser
(1A), (20A), (30A), 850A), (60A), (70A), (80A), (90A): condensation section
(1B), (20B), (30B), (50B): super-cooling section
(2): heat exchange tube
(2*a*), (2*b*): bent portion
(3): first header tank
(4): second header tank
(5), (71): third header tank
(33): gas-liquid separation member
(35): desiccant
(40): filter
(72): fourth header tank
(P1): first heat exchange path
(P2): second heat exchange path
(P3): third heat exchange path
(P4): fourth heat exchange path Mode For Carrying Out The Invention Embodiments of the present invention will next be described with reference to the drawings.

In the following description, the direction toward the reverse side of a sheet on which FIG. 1 is drawn (the upper side in FIG. 2) will be referred to as the "front," and the opposite side as the "rear."

Furthermore, the term "aluminum" as used in the following description encompasses aluminum alloys in addition to pure aluminum.

Moreover, the same reference numerals are used throughout the drawings to refer to the same portions and members, and their repeated descriptions are omitted.

Figure 2:
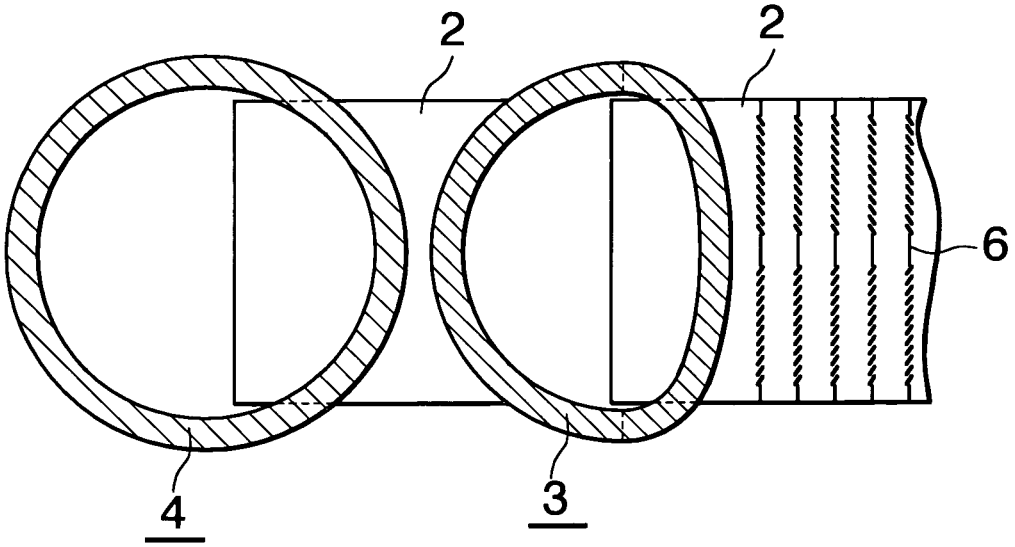
FIG. 2 is an enlarged sectional view taken along line A-A of FIG. 1.
Figure 3:
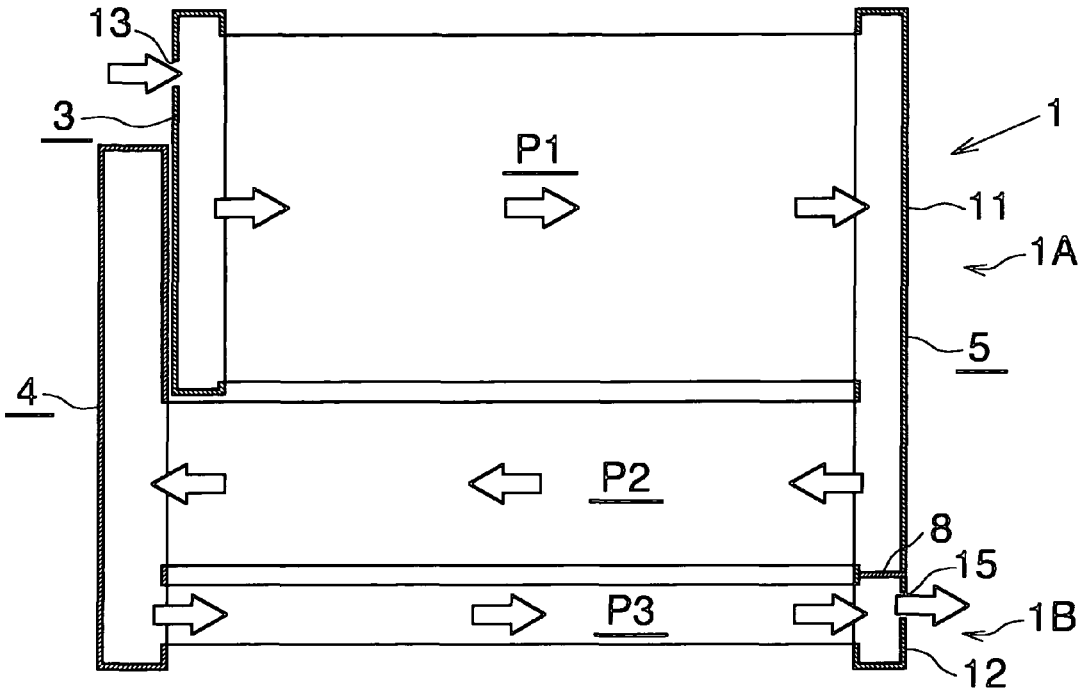
FIG. 3 is a front view schematically showing the condenser of FIG. 1.

FIG. 1 specifically shows the overall structure of a condenser according to the present invention; FIG. 2 shows the structure of a main portion thereof; and FIG. 3 schematically shows the condenser according to the present invention. In FIG. 3, individual heat exchange tubes are omitted, and corrugate fins, side plates, a refrigerant inlet member, and a refrigerant outlet member are also omitted.

In FIG. 1, a condenser (1) includes a plurality of flat heat exchange tubes (2) formed of aluminum, three header tanks (3), (4), and (5) formed of aluminum, corrugate fins (6) formed of aluminum, and side plates (7) formed of aluminum. The heat exchange tubes (2) are disposed such that their width direction coincides with a front-rear direction, their length direction coincides with a left-right direction, and they are spaced from one another in a vertical direction.

Left and right end portions of the heat exchange tubes (2) are connected, by means of brazing, to the header tanks (3), (4), and (5), which extend in the vertical direction. Each of the corrugate fins (6) is disposed between and brazed to adjacent heat exchange tubes (2), or is disposed on the outer side of the uppermost or lowermost heat exchange tube (2) and brazed to the corresponding heat exchange tube (2). The side plates (7) are disposed on the corresponding outer sides of the uppermost and lowermost corrugate fins (6), and are brazed to these corrugate fins (6). Three heat exchange paths (P1), (P2), and (P3) each formed by a plurality of heat exchange tubes (2) successively arranged in the vertical direction are juxtaposed in the vertical direction. The three heat exchange paths will be referred to as the first to third heat exchange paths (P1), (P2), and (P3) from the upper side. The flow direction of refrigerant is the same among all the heat exchange tubes (2) which constitute the respective heat exchange paths (P1), (P2), and (P3). The flow direction of refrigerant in the heat exchange tubes (2) which constitute a certain heat exchange path is opposite the flow direction of refrigerant in the heat exchange tubes (2) which constitute another heat exchange path adjacent to the certain heat exchange path.

As shown in FIGS. 1 to 3, the first header tank (3) and the second header tank (4) are provided separately on the left end side of the condenser (1). The heat exchange tubes (2) which form the first heat exchange path (P1) (at least the uppermost heat exchange path) are connected to the first header tank (3) by means of brazing. The heat exchange tubes (2) which form the second and third heat exchange paths (P2) and (P3) (a heat exchange path(s) provided below the heat exchange path (P1) formed by the heat exchange tubes (2) connected to the first header tank (3)) are connected to the second header tank (4) by means of brazing. The second header tank (4) is thicker than the first header tank (3). The second header tank (4) is located on the left side (on the outer side with respect to the left-right direction) of the first header tank (3), and the center lines of the first and second header tanks (3) and (4) are located on the same vertical plane extending in the left-right direction. The upper end of the second header tank (4) is located above the lower end of the first header tank (3), and the second header tank (4) has a gas-liquid separation function. That is, the second header tank (4) has an internal volume determined such that a portion of gas-liquid mixed phase refrigerant having flowed into the second header tank (4); i.e., liquid-predominant mixed phase refrigerant, stays in a lower region within the second header tank (4) because of gravitational force, and the gas phase component of the gas-liquid mixed phase refrigerant stays in an upper region within the second header tank (4) because of gravitational force, whereby only the liquid-predominant mixed phase refrigerant flows into the heat exchange tubes (2) of the third heat exchange path (P3).

The third header tank (5) is disposed on the right end side of the condenser (1), and all the heat exchange tubes (2) which constitute the first to third heat exchange paths (P1) to (P3) are connected to the third header tank (5). The transverse cross sectional shape of the third header tank (5) is identical with that of the first header tank (3). The interior of the third header tank (5) is divided into an upper header section (11) and a lower header section (12) by means of an aluminum partition plate (8) provided at a height between the second heat exchange path (P2) and the third heat exchange path (P3).

The first header tank (3), a portion of the second header tank (4) to which the heat exchange tubes (2) of the second heat exchange path (P2) are connected, the upper header section (11) of the third header tank (5), the first heat exchange path (P1), and the second heat exchange path (P2) form a condensation section (1A), which condensates refrigerant. A portion of the second header tank (4) to which the heat exchange tubes (2) of the third heat exchange path (P3) are connected, the lower header section (12) of the third header tank (5), and the third heat exchange path (P3) form a super-cooling section (1B), which super-cools refrigerant. The first and second heat exchange paths (P1) and (P2) (a heat exchange path formed by the heat exchange tubes (2) connected to the first header tank (3) and the uppermost heat exchange path of the heat exchange paths formed by the heat exchange tubes (2) connected to the second header tank (4)) each serve as a refrigerant condensation path for condensing refrigerant. The third heat exchange path (P3) (the heat exchange path(s) formed by the heat exchange tubes (2) connected to the second header tank (4), excluding the uppermost heat exchange path) serves as a refrigerant super-cooling path for super-cooling refrigerant.

A refrigerant inlet (13) is formed in an upper end portion of the first header tank (3), which constitutes the condensation section (1A). A refrigerant outlet (15) is formed in the lower header section (12) of the third header tank (5), which constitutes the super-cooling section (1B). A refrigerant inlet member (14) communicating with the refrigerant inlet (13) is joined to the first header tank (3). A refrigerant outlet member (16) communicating with the refrigerant outlet (15) is joined to the lower header section (12) of the third header tank (5).

All the heat exchange tubes (2) are straight; and left end portions (end portions on the side toward the second header tank (4)) of the heat exchange tubes (2) connected to the second header tank (4) extend leftward beyond left end portions (end portions on the side toward the first header tank (3)) of the heat exchange tubes (2) connected to the first header tank (3).

The condenser (1) is manufactured through batch brazing of all the components.

The condenser (1) constitutes a refrigeration cycle in cooperation with a compressor, an expansion valve (pressure reducer), and an evaporator; and the refrigeration cycle is mounted on a vehicle as a car air conditioner.

In the condenser (1) having the above-described structure, gas phase refrigerant of high temperature and high pressure compressed by the compressor flows into the first header tank (3) via the refrigerant inlet member (14) and the refrigerant inlet (13). The gas phase refrigerant is condensed while flowing rightward within the heat exchange tubes (2) of the first heat exchange path (P1), and flows into the upper header section (11) of the third header tank (5). The refrigerant having flowed into the upper header section (11) of the third header tank (5) is condensed while flowing leftward within the heat exchange tubes (2) of the second heat exchange path (P2), and flows into the second header tank (4).

The refrigerant having flowed into the second header tank (4) is gas-liquid mixed phase refrigerant. A portion of the gas-liquid mixed phase refrigerant; i.e., liquid-predominant mixed phase refrigerant, stays in a lower region within the second header tank (4) because of gravitational force, and enters the heat exchange tubes (2) of the third heat exchange path (P3). The liquid-predominant mixed phase refrigerant having entered the heat exchange tubes (2) of the third heat exchange path (P3) is super-cooled while flowing rightward within the heat exchange tubes (2). After that, the super-cooled refrigerant enters the lower header section (12) of the third header tank (5), and flows out via the refrigerant outlet (15) and the refrigerant outlet member (16). The refrigerant is then fed to the evaporator via the expansion valve.

Meanwhile, the gas phase component of the gas-liquid mixed phase refrigerant having flowed into the second header tank (4) stays in an upper region within the second header tank (4).

FIGS. 4 to 12 show other embodiments of the condenser according to the present invention. Notably, in FIGS. 4, 5, and 8 to 12, which schematically show the condenser, the individual heat exchange tubes are omitted, and the corrugate fins, the side plates, the refrigerant inlet member, and the refrigerant outlet member are also omitted.

Figure 4:
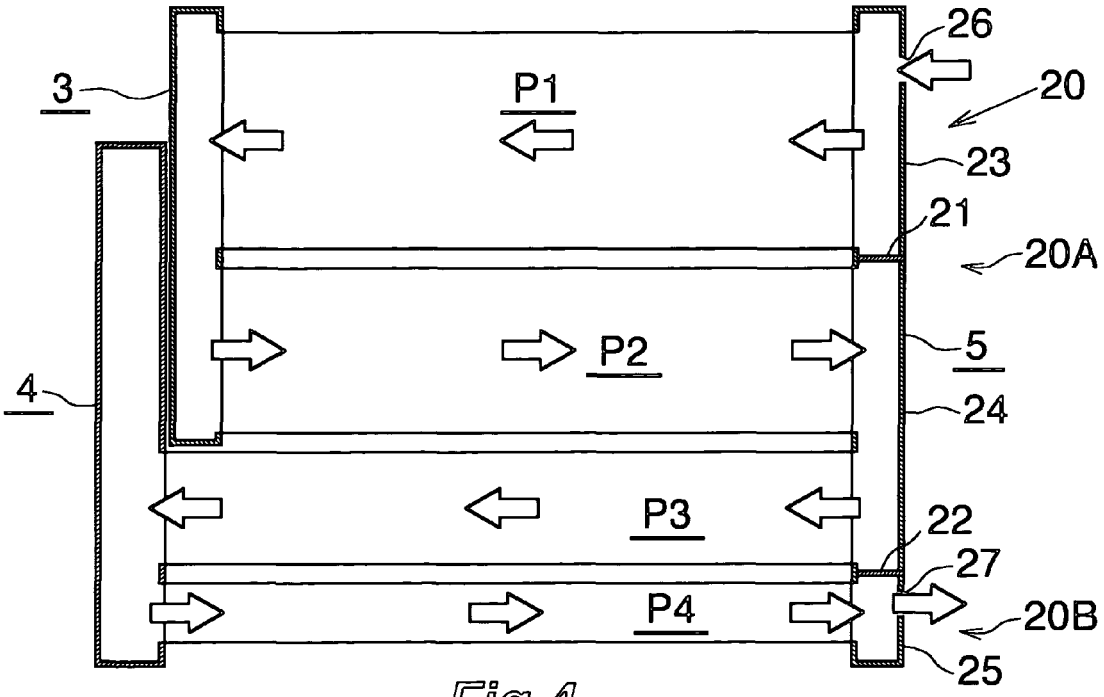
FIG. 4 is a front view schematically showing a second embodiment of the condenser according to the present invention.

In the case of a condenser (20) shown in FIG. 4, four heat exchange paths (P1), (P2), (P3), and (P4) each formed by a plurality of heat exchange tubes (2) successively arranged in the vertical direction are juxtaposed in the vertical direction. The four heat exchange paths will be referred to as the first to fourth heat exchange paths (P1), (P2), (P3), and (P4) from the upper side. The flow direction of refrigerant is the same among all the heat exchange tubes (2) which constitute the respective heat exchange paths (P1), (P2), (P3), and (P4). The flow direction of refrigerant in the heat exchange tubes (2) which constitute a certain heat exchange path is opposite the flow direction of refrigerant in the heat exchange tubes (2) which constitute another heat exchange path adjacent to the certain heat exchange path.

Left and right end portions of the heat exchange tubes (2) which constitute the first and second heat exchange paths (P1) and (P2) are connected to the first header tank (3) and the third header tank (5), respectively, by means of brazing. Left and right end portions of the heat exchange tubes (2) which constitute the third and fourth heat exchange paths (P3) and (P4) are connected to the second header tank (4) and the third header tank (5), respectively, by means of brazing.

The interior of the third header tank (5) is divided into an upper header section (23), an intermediate header section (24), and a lower header section (25) by aluminum partition plates (21) and (22), which are provided at a height between the first heat exchange path (P1) and the second heat exchange path (P2) and a height between the third heat exchange path (P3) and the fourth heat exchange path (P4), respectively. Left end portions of the heat exchange tubes (2) of the first heat exchange path (P1) are connected to the first header tank (3), and right end portions thereof are connected to the upper header section (23) of the third header tank (5). A left end portion of the second heat exchange path (P2) is connected to the first header tank (3), and a right end portion thereof is connected to the intermediate header section (24) of the third header tank (5). Left end portions of the heat exchange tubes (2) of the third heat exchange path (P3) are connected to the second header tank (4), and right end portions thereof are connected to the intermediate header section (24) of the third header tank (5). Left end portions of the heat exchange tubes (2) of the fourth heat exchange path (P4) are connected to the second header tank (4), and right end portions thereof are connected to the lower header section (25) of the third header tank (5).

The first header tank (3), a portion of the second header tank (4) to which the heat exchange tubes (2) of the third heat exchange path (P3) are connected, the upper and intermediate header sections (23) and (24) of the third header tank (5), and the first to third heat exchange paths (P1) to (P3) form a condensation section (20A), which condenses refrigerant. A portion of the second header tank (4) to which the heat exchange tubes (2) of the fourth heat exchange path (P4) are connected, the lower header section (25) of the third header tank (5), and the fourth heat exchange path (P4) form a super-cooling section (20B), which super-cools refrigerant. The first to third heat exchange paths (P1) to (P3) each serve as a refrigerant condensation path for condensing refrigerant, and the fourth heat exchange path (P4) serves as a refrigerant super-cooling path for super-cooling refrigerant.

A refrigerant inlet (26) is formed in the upper header section (23) of the third header tank (5), which constitutes the condensation section (20A), and a refrigerant outlet (27) is formed in the third header tank (5), which constitutes the super-cooling section (20B). A refrigerant inlet member (not shown) communicating with the refrigerant inlet (26) is joined to the upper header section (23) of the third header tank (5), and a refrigerant outlet member (not shown) communicating with the refrigerant outlet (27) is joined to the lower header section (25) of the third header tank (5).

The remaining structure is similar to that of the condenser shown in FIGS. 1 to 3.

In the condenser (20) shown in FIG. 4, gas phase refrigerant of high temperature and high pressure compressed by the compressor flows into the upper header section (23) of the third header tank (5) via the refrigerant inlet member and the refrigerant inlet (26). The gas phase refrigerant is condensed while flowing leftward within the heat exchange tubes (2) of the first heat exchange path (P1), and then flows into the first header tank (3). The refrigerant having flowed into the first header tank (3) is condensed while flowing rightward within the heat exchange tubes (2) of the second heat exchange path (P2), and then flows into the intermediate header section (24) of the third header tank (5). The refrigerant having flowed into the intermediate header section (24) of the third header tank (5) is condensed while flowing leftward within the heat exchange tubes (2) of the third heat exchange path (P3), and then flows into the second header tank (4).

The refrigerant having flowed into the second header tank (4) is gas-liquid mixed phase refrigerant. A portion of the gas-liquid mixed phase refrigerant; i.e., liquid-predominant mixed phase refrigerant, stays in a lower region within the second header tank (4) because of gravitational force, and enters the heat exchange tubes (2) of the fourth heat exchange path (P4). The liquid-predominant mixed phase refrigerant having entered the heat exchange tubes (2) of the fourth heat exchange path (P4) is super-cooled while flowing rightward within the heat exchange tubes (2). After that, the super-cooled refrigerant enters the lower header section (25) of the third header tank (5), and flows out via the refrigerant outlet (27) and the refrigerant outlet member. The refrigerant is then fed to the evaporator via the expansion valve.

Meanwhile, the gas phase component of the gas-liquid mixed phase refrigerant having flowed into the second header tank (4) stays in an upper region within the second header tank (4).

Figure 5:
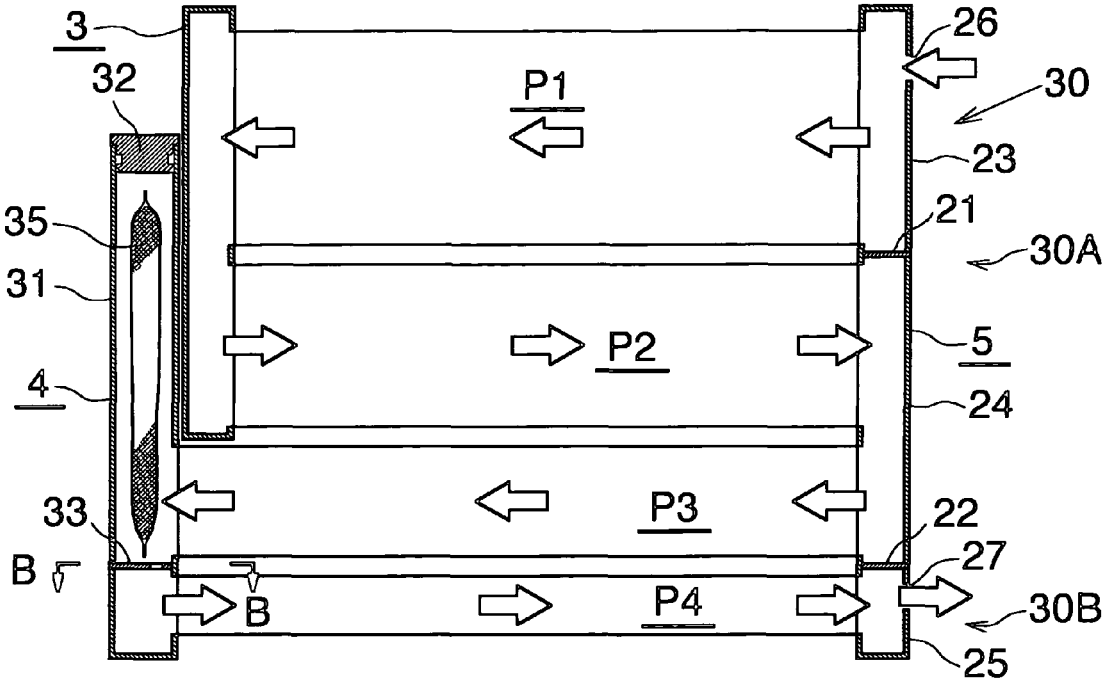
FIG. 5 is a front view schematically showing a third embodiment of the condenser according to the present invention.
Figure 6:
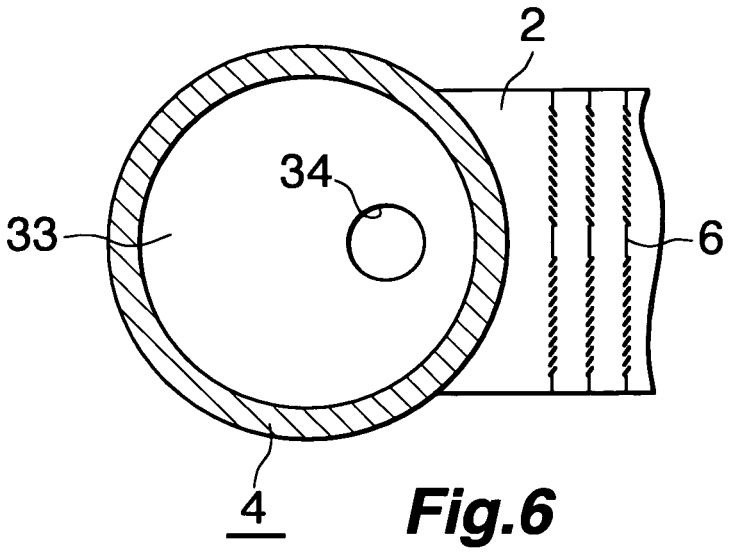
FIG. 6 is an enlarged sectional view taken along line B-B of FIG. 5.

In the case of a condenser (30) shown in FIGS. 5 and 6, the second header tank (4) is composed of a tubular main body (31), which is formed of aluminum and which has an open upper end and a closed lower end; and a lid (32), which is removably attached to the upper end of the tubular main body (31) so as to close the upper end opening of the tubular main body (31). When the condenser (30) is manufactured, only the tubular main body (31) undergoes batch brazing simultaneously with other members. After manufacture of the condenser (30), the lid (32) is attached to the tubular main body (31).

Furthermore, a gas-liquid separation member (33) formed of aluminum is disposed within the second header tank (4) at a height between the third heat exchange path (P3) and the fourth heat exchange path (P4). The gas-liquid separation member (33) assumes a plate-like shape, and has a rectifying through hole (34) formed therein. The gas-liquid separation member (33) prevents the influence of agitating swirls, generated by the flow of the refrigerant flowing from the heat exchange tubes (2) of the third heat exchange path (P3) into the second header tank (4), from propagating to a portion of the interior of the second header tank (4) located below the gas-liquid separation member (33), to thereby cause the gas phase component of the gas-liquid mixed phase refrigerant to stay in the upper portion of the interior of the second header tank (4). As a result, only the liquid-predominant mixed phase refrigerant is fed to the portion of the interior of the second header tank (4) located below the gas-liquid separation member (33) via the rectifying through hole (34), whereby the liquid-predominant mixed phase refrigerant effectively flows into the heat exchange tubes (2) of the fourth heat exchange path (P4).

Furthermore, a desiccant (35) is disposed in a portion of the interior of the second header tank (4) located above the gas-liquid separation member (33). The desiccant (35) removes moisture from the refrigerant flowing into the second header tank (4) via the heat exchange tubes (2) of the third heat exchange path (P3). The desiccant (35) is placed in the tubular main body (31) after manufacture of the condenser (30) but before attachment of the lid (32) to the tubular main body (31).

The remaining structure is similar to that of the condenser (20) shown in FIG. 4, and refrigerant flows in the same manner as in the case of the condenser (20) shown in FIG. 4. Notably, in FIGS. 5 and 6, a condensation section having a configuration similar to that of the condenser (20) shown in FIG. 4 will be denoted by (30A), and a super-cooling section having a configuration similar to that of the condenser (20) shown in FIG. 4 is denoted by (30B).

Figure 7:
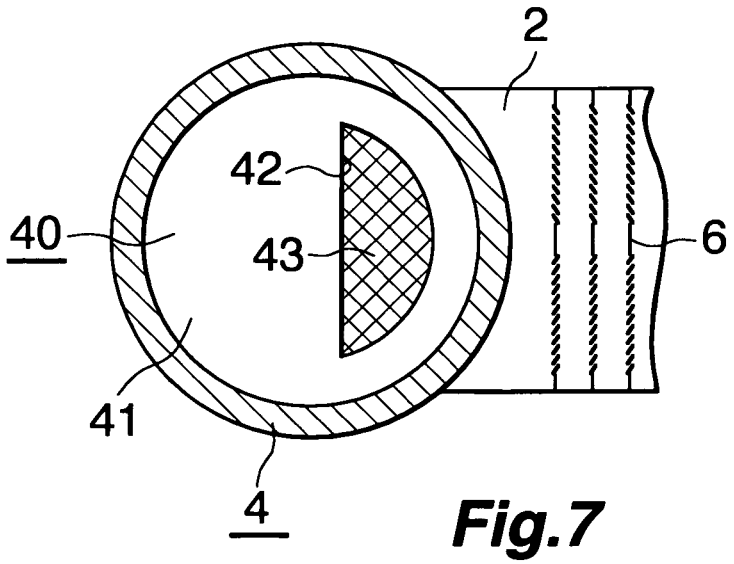
FIG. 7 is a view corresponding to FIG. 6 and showing a modification of the second header tank of the condenser shown in FIG. 5.

In the condenser (30) shown in FIGS. 5 and 6, instead of the gas-liquid separation member (33), a filter (40) as shown in FIG. 7 may be disposed within the second header tank (4) at a height between the third heat exchange path (P3) and the fourth heat exchange path (P4). The filter (40) is composed of an aluminum plate-like body (41) having a through hole (42), and a stainless steel mesh (43) fixed to the body (41) to cover the through hole (42). In this case, foreign objects contained in refrigerant can be removed.

Figure 8:
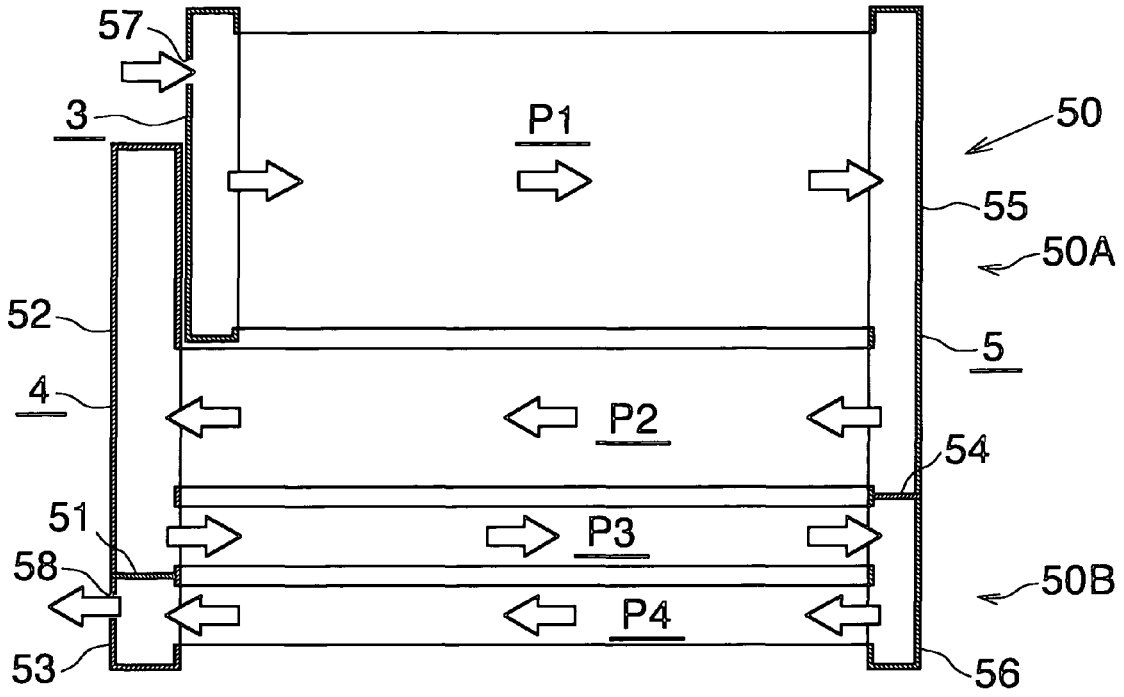
FIG. 8 is a front view schematically showing a fourth embodiment of the condenser according to the present invention.

In the case of a condenser (50) shown in FIG. 8, four heat exchange paths (P1), (P2), (P3), and (P4) each formed by a plurality of heat exchange tubes (2) successively arranged in the vertical direction are juxtaposed in the vertical direction. The four heat exchange paths will be referred to as the first to fourth heat exchange paths (P1), (P2), (P3), and (P4) from the upper side. The flow direction of refrigerant is the same among all the heat exchange tubes (2) which constitute the respective heat exchange paths (P1), (P2), (P3), and (P4). The flow direction of refrigerant in the heat exchange tubes (2) which constitute a certain heat exchange path is opposite the flow direction of refrigerant in the heat exchange tubes (2) which constitute another heat exchange path adjacent to the certain heat exchange path.

Left and right end portions of the heat exchange tubes (2) which constitute the first heat exchange path (P1) are connected to the first header tank (3) and the third header tank (5), respectively, by means of brazing. Left and right end portions of the heat exchange tubes (2) which constitute the second through fourth heat exchange paths (P2), (P3), and (P4) are connected to the second header tank (4) and the third header tank (5), respectively, by means of brazing.

The interior of the second header tank (4) is divided into an upper header section (52) and a lower header section (53) by an aluminum partition plate (51) provided at a height between the third heat exchange path (P3) and the fourth heat exchange path (P4). The interior of the third header tank (5) is divided into an upper header section (55) and a lower header section (56) by an aluminum partition plates (54) provided at a height between the second heat exchange path (P2) and the third heat exchange path (P3). Left end portions of the heat exchange tubes (2) of the first heat exchange path (P1) are connected to the first header tank (3), and right end portions thereof are connected to the upper header section (55) of the third header tank (5). A left end portion of the second heat exchange path (P2) is connected to the upper header section (52) of the second header tank (4), and a right end portion thereof is connected to the upper header section (55) of the third header tank (5). Left end portions of the heat exchange tubes (2) of the third heat exchange path (P3) are connected to the upper header section (52) of the second header tank (4), and right end portions thereof are connected to the lower header section (56) of the third header tank (5). Left end portions of the heat exchange tubes (2) of the fourth heat exchange path (P4) are connected to the lower header section (53) of the second header tank (4), and right end portions thereof are connected to the lower header section (56) of the third header tank (5).

The first header tank (3), a portion of the second header tank (4) to which the heat exchange tubes (2) of the second heat exchange path (P2) are connected, the upper header section (55) of the third header tank (5), and the first and second heat exchange paths (P1) and (P2) form a condensation section (50A), which condenses refrigerant. A portion of the second header tank (4) to which the heat exchange tubes (2) of the third and fourth heat exchange paths (P3) and (P4) are connected, the lower header section (56) of the third header tank (5), and the third and fourth heat exchange paths (P3) and (P4) form a super-cooling section (50B), which super-cools refrigerant. The first and second heat exchange paths (P1) and (P2) each serve as a refrigerant condensation path for condensing refrigerant, and the third and fourth heat exchange paths (P3) and (P4) each serve as a refrigerant super-cooling path for super-cooling refrigerant.

A refrigerant inlet (57) is formed in an upper end portion of the first header tank (3), which constitutes the condensation section (50A), and a refrigerant outlet (58) is formed in the lower header section (53) of the second header tank (4), which constitutes the super-cooling section (1B). A refrigerant inlet member (not shown) communicating with the refrigerant inlet (57) is joined to the first header tank (3), and a refrigerant outlet member (not shown) communicating with the refrigerant outlet (58) is joined to the second header tank (4).

The remaining structure is similar to that of the condenser shown in FIGS. 1 to 3.

In the condenser (1) shown in FIG. 8, gas phase refrigerant of high temperature and high pressure compressed by the compressor flows into the first header tank (3) via the refrigerant inlet member and the refrigerant inlet (57). The gas phase refrigerant is condensed while flowing rightward within the heat exchange tubes (2) of the first heat exchange path (P1), and then flows into the upper header section (55) of the third header tank (5). The refrigerant having flowed into the upper header section (55) of the third header tank (5) is condensed while flowing leftward within the heat exchange tubes (2) of the second heat exchange path (P2), and then flows into the upper header section (52) of the second header tank (4).

The refrigerant having flowed into the upper header section (52) of the second header tank (4) is gas-liquid mixed phase refrigerant. A portion of the gas-liquid mixed phase refrigerant; i.e., liquid-predominant mixed phase refrigerant, stays in a lower region within the upper header section (52) of the second header tank (4) because of gravitational force, and enters the heat exchange tubes (2) of the third heat exchange path (P3). The liquid-predominant mixed phase refrigerant having entered the heat exchange tubes (2) of the third heat exchange path (P3) is super-cooled while flowing rightward within the heat exchange tubes (2), and flows into the lower header section (56) of the third header tank (5). The liquid-predominant mixed phase refrigerant having flowed into the lower header section (56) of the third header tank (5) is super-cooled while flowing leftward within the heat exchange tubes (2) of the fourth heat exchange path (P4). After that, the super-cooled refrigerant enters the lower header section (53) of the second header tank (4), and flows out via the refrigerant outlet (58) and the refrigerant outlet member. The refrigerant is then fed to the evaporator via the expansion valve.

Meanwhile, the gas phase component of the gas-liquid mixed phase refrigerant having flowed into the upper header section (52) of the second header tank (4) stays in an upper region within the upper header section (52) of the second header tank (4).

Figure 9:
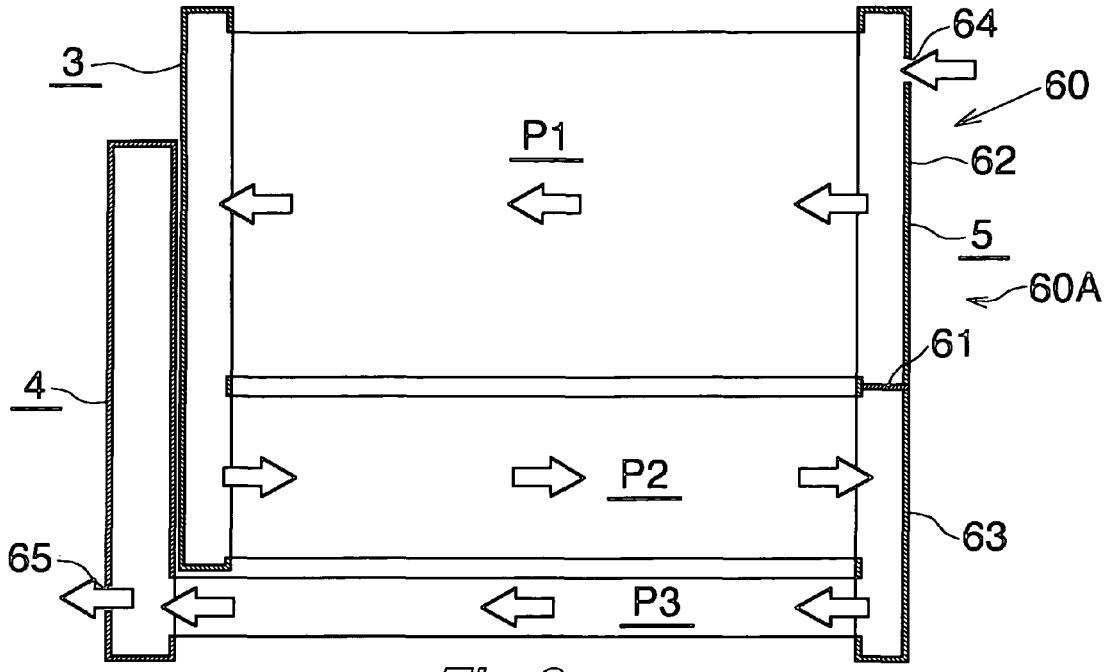
FIG. 9 is a front view schematically showing a fifth embodiment of the condenser according to the present invention.

In the case of a condenser (60) shown in FIG. 9, three heat exchange paths (P1), (P2), and (P3) each formed by a plurality of heat exchange tubes (2) successively arranged in the vertical direction are juxtaposed in the vertical direction. The three heat exchange paths will be referred to as the first to third heat exchange paths (P1), (P2), and (P3) from the upper side. The flow direction of refrigerant is the same among all the heat exchange tubes (2) which constitute the respective heat exchange paths (P1), (P2), and (P3). The flow direction of refrigerant in the heat exchange tubes (2) which constitute a certain heat exchange path is opposite the flow direction of refrigerant in the heat exchange tubes (2) which constitute another heat exchange path adjacent to the certain heat exchange path.

Left and right end portions of the heat exchange tubes (2) which constitute the first and second heat exchange paths (P1) and (P2) are connected to the first header tank (3) and the third header tank (5), respectively, by means of brazing. Left and right end portions of the heat exchange tubes (2) which constitute the third heat exchange path (P3) are connected to the second header tank (4) and the third header tank (5), respectively, by means of brazing.

The interior of the third header tank (5) is divided into an upper header section (62) and a lower header section (63) by an aluminum partition plate (61) provided at a height between the first heat exchange path (P1) and the second heat exchange path (P2). Left end portions of the heat exchange tubes (2) of the first heat exchange path (P1) are connected to the first header tank (3), and right end portions thereof are connected to the upper header section (62) of the third header tank (5). A left end portion of the second heat exchange path (P2) is connected to the first header tank (3), and a right end portion thereof is connected to the lower header section (63) of the third header tank (5). Left end portions of the heat exchange tubes (2) of the third heat exchange path (P3) are connected to the second header tank (4), and right end portions thereof are connected to the lower header section (63) of the third header tank (5).

The first to third header tank (3) to (5) and the first to third heat exchange paths (P1) to (P3) form a condensation section (60A), which condenses refrigerant. The first to third heat exchange paths (P1) to (P3); i.e., all the heat exchange paths, serve as a refrigerant condensation path for condensing refrigerant.

A refrigerant inlet (64) is formed in an upper end portion of the upper header section (62) of the third header tank (5), which constitutes the condensation section (60A), and a refrigerant outlet (65) is formed in a lower end portion of the second header tank (4). A refrigerant inlet member (not shown) communicating with the refrigerant inlet (64) is joined to the upper header section (62) of the third header tank (5), and a refrigerant outlet member (not shown) communicating with the refrigerant outlet (65) is joined to the second header tank (4).

The remaining structure is similar to that of the condenser shown in FIGS. 1 to 3.

In the condenser (60) shown in FIG. 9, gas phase refrigerant of high temperature and high pressure compressed by the compressor flows into the upper header section (62) of the third header tank (5) via the refrigerant inlet member and the refrigerant inlet (64). The gas phase refrigerant is condensed while flowing leftward within the heat exchange tubes (2) of the first heat exchange path (P1), and then flows into the first header tank (3). The refrigerant having flowed into the first header tank (3) is condensed while flowing rightward within the heat exchange tubes (2) of the second heat exchange path (P2), and then flows into the lower header section (63) of the third header tank (5). The refrigerant having flowed into the lower header section (63) of the third header tank (5) is condensed while flowing leftward within the heat exchange tubes (2) of the third heat exchange path (P3), and then flows into the second header tank (4).

The refrigerant having flowed into the second header tank (4) is gas-liquid mixed phase refrigerant. A portion of the gas-liquid mixed phase refrigerant; i.e., liquid-predominant mixed phase refrigerant, stays in a lower region within the second header tank (4) because of gravitational force, and flows out via the refrigerant outlet (65) and the refrigerant outlet member. The refrigerant is then fed to the evaporator via the expansion valve.

Meanwhile, the gas phase component of the gas-liquid mixed phase refrigerant having flowed into the second header tank (4) stays in an upper region within the second header tank (4).

Figure 10:
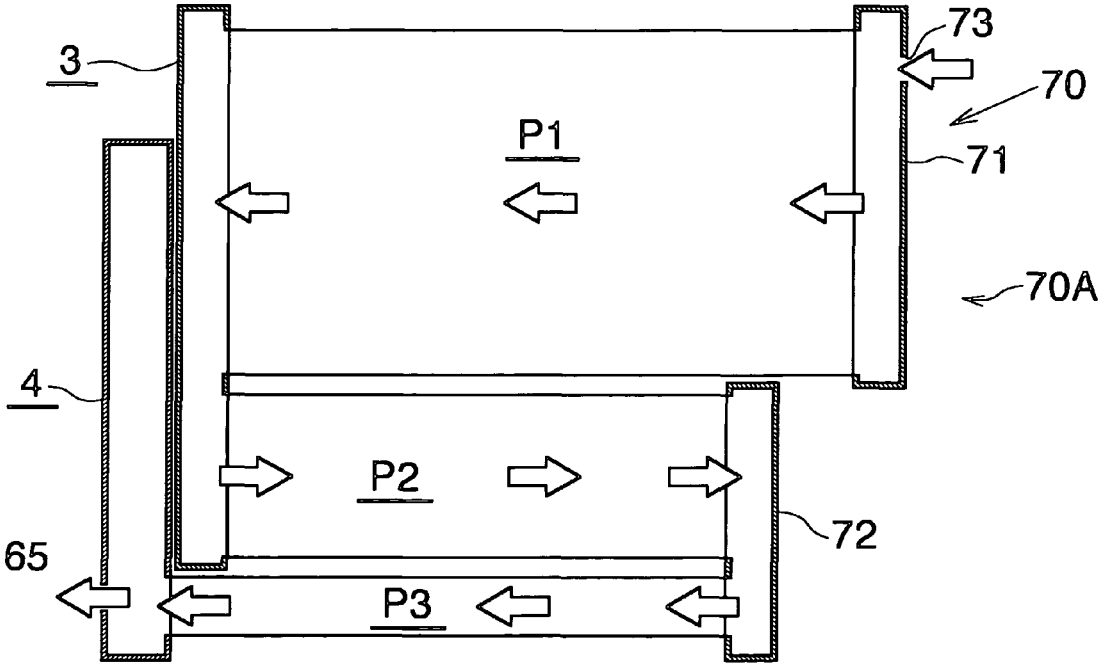
FIG. 10 is a front view schematically showing a sixth embodiment of the condenser according to the present invention.

In the case of a condenser (70) shown in FIG. 10, a third header tank (71) and a fourth header tank (72) are provided individually on the right end side. The heat exchange tubes (2) of the first heat exchange path (P1) are connected to the third header tank (71) by means of brazing. The fourth header tank (72) is disposed below the third header tank (71), and the heat exchange tubes (2) of the second and third heat exchange paths (72) and (P3) are connected to the fourth header tank (72) by means of brazing. The fourth header tank (72) is provided on the left side (the inner side with respect to the left-right direction) of the third header tank (71). Left end portions of the heat exchange tubes (2) of the first heat exchange path (P1) are connected to the first header tank (3), and right end portions thereof are connected to the third header tank (71). A left end portion of the second heat exchange path (P2) is connected to the first header tank (3), and a right end portion thereof is connected to the fourth header tank (72). Left end portions of the heat exchange tubes (2) of the third heat exchange path (P3) are connected to the second header tank (4), and right end portions thereof are connected to the fourth header tank (72).

The first to fourth header tank (3), (4), (71), and (72) and the first to third heat exchange paths (P1) to (P3) form a condensation section (70A), which condenses refrigerant. The first to third heat exchange paths (P1) to (P3); i.e., all the heat exchange paths, serve as a refrigerant condensation path for condensing refrigerant.

A refrigerant inlet (73) is formed in an upper end portion of the third header tank (71), which constitutes the condensation section (70A), and a refrigerant outlet (65) is formed in a lower end portion of the second header tank (4). A refrigerant inlet member (not shown) communicating with the refrigerant inlet (73) is joined to the third header tank (5), and a refrigerant outlet member (not shown) communicating with the refrigerant outlet (65) is joined to the second header tank (4).

The remaining structure is similar to that of the condenser shown in FIG. 9.

In the condenser (1) shown in FIG. 10, gas phase refrigerant of high temperature and high pressure compressed by the compressor flows into the third header tank (71) via the refrigerant inlet member and the refrigerant inlet (73). The gas phase refrigerant is condensed while flowing leftward within the heat exchange tubes (2) of the first heat exchange path (P1), and then flows into the first header tank (3). The refrigerant having flowed into the first header tank (3) is condensed while flowing rightward within the heat exchange tubes (2) of the second heat exchange path (P2), and then flows into the fourth header tank (72). The refrigerant having flowed into the fourth header tank (72) is condensed while flowing leftward within the heat exchange tubes (2) of the third heat exchange path (P3), and then flows into the second header tank (4).

The refrigerant having flowed into the second header tank (4) is gas-liquid mixed phase refrigerant. A portion of the gas-liquid mixed phase refrigerant; i.e., liquid-predominant mixed phase refrigerant, stays in a lower region within the second header tank (4) because of gravitational force, and flows out via the refrigerant outlet (65) and the refrigerant outlet member. The refrigerant is then fed to the evaporator via the expansion valve.

Meanwhile, the gas phase component of the gas-liquid mixed phase refrigerant having flowed into the second header tank (4) stays in an upper region within the second header tank (4).

Figure 11:
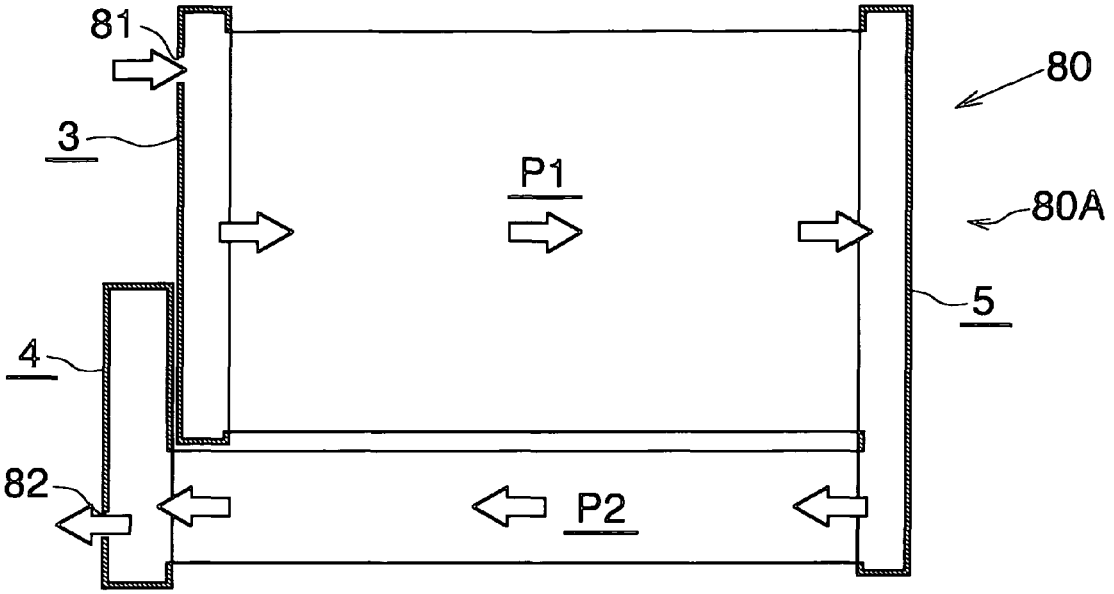
FIG. 11 is a front view schematically showing a seventh embodiment of the condenser according to the present invention.

In the case of a condenser (80) shown in FIG. 11, two heat exchange paths (P1) and (P2) each formed by a plurality of heat exchange tubes (2) successively arranged in the vertical direction are juxtaposed in the vertical direction.

The two heat exchange paths will be referred to as the first and second heat exchange paths (P1) and (P2) from the upper side. The flow direction of refrigerant is the same among all the heat exchange tubes (2) which constitute the respective heat exchange paths (P1) and (P2). The flow direction of refrigerant in the heat exchange tubes (2) which constitute one heat exchange path is opposite the flow direction of refrigerant in the heat exchange tubes (2) which constitute the other adjacent heat exchange path.

Left and right end portions of the heat exchange tubes (2) which constitute the first heat exchange path (P1) are connected to the first header tank (3) and the third header tank (5), respectively, by means of brazing. Left and right end portions of the heat exchange tubes (2) which constitute the second heat exchange path (P2) are connected to the second header tank (4) and the third header tank (5), respectively, by means of brazing.

The first to third header tank (3) to (5) and the first and second heat exchange paths (P1) and (P2) form a condensation section (80A), which condenses refrigerant. The first and second heat exchange paths (P1) and (P2); i.e., all the heat exchange paths, serve as a refrigerant condensation path for condensing refrigerant.

A refrigerant inlet (81) is formed in an upper end portion of the first header tank (5), which constitutes the condensation section (80A), and a refrigerant outlet (82) is formed in a lower end portion of the second header tank (4). A refrigerant inlet member (not shown) communicating with the refrigerant inlet (81) is joined to the first header tank (5), and a refrigerant outlet member (not shown) communicating with the refrigerant outlet (82) is joined to the second header tank (4).

The remaining structure is similar to that of the condenser shown in FIGS. 1 to 3.

In the condenser (80) shown in FIG. 11, gas phase refrigerant of high temperature and high pressure compressed by the compressor flows into the first header tank (3) via the refrigerant inlet member and the refrigerant inlet (81). The gas phase refrigerant is condensed while flowing rightward within the heat exchange tubes (2) of the first heat exchange path (P1), and then flows into the third header tank (5). The refrigerant having flowed into the third header tank (5) is condensed while flowing leftward within the heat exchange tubes (2) of the second heat exchange path (P2), and then flows into the second header tank (4).

The refrigerant having flowed into the second header tank (4) is gas-liquid mixed phase refrigerant. A portion of the gas-liquid mixed phase refrigerant; i.e., liquid-predominant mixed phase refrigerant, stays in a lower region within the second header tank (4) because of gravitational force, and flows out via the refrigerant outlet (82) and the refrigerant outlet member. The refrigerant is then fed to the evaporator via the expansion valve.

Meanwhile, the gas phase component of the gas-liquid mixed phase refrigerant having flowed into the second header tank (4) stays in an upper region within the second header tank (4).

Figure 12:
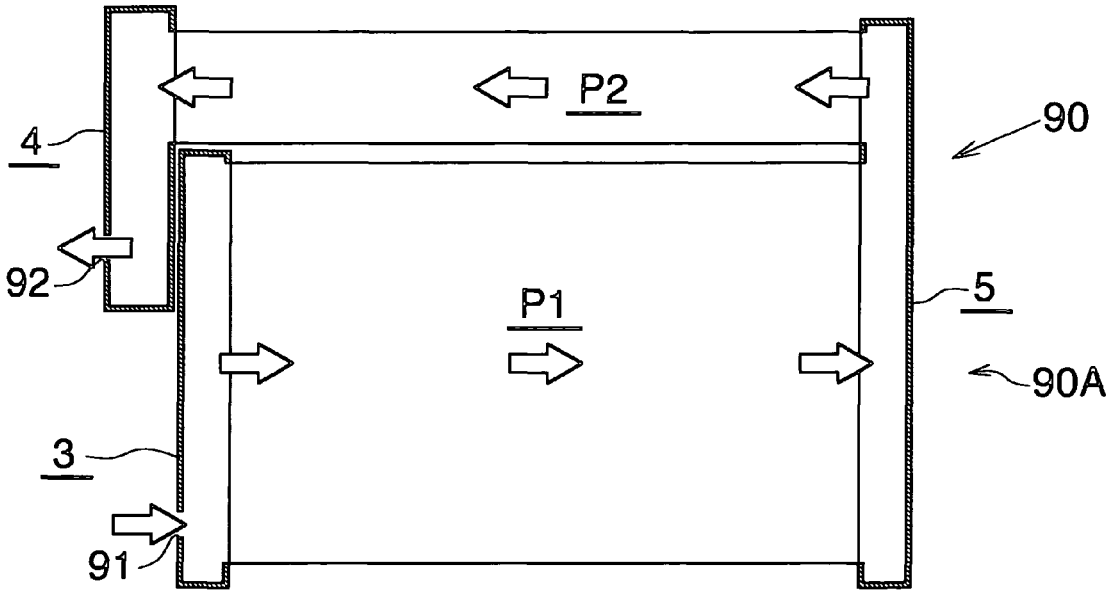
FIG. 12 is a front view schematically showing an eighth embodiment of the condenser according to the present invention.

In the case of a condenser (90) shown in FIG. 12, two heat exchange paths (P1) and (P2) each formed by a plurality of heat exchange tubes (2) successively arranged in the vertical direction are juxtaposed in the vertical direction.

The two heat exchange paths will be referred to as the first and second heat exchange paths (P1) and (P2) from the lower side. The flow direction of refrigerant is the same among all the heat exchange tubes (2) which constitute the respective heat exchange paths (P1) and (P2). The flow direction of refrigerant in the heat exchange tubes (2) which constitute one heat exchange path is opposite the flow direction of refrigerant in the heat exchange tubes (2) which constitute the other adjacent heat exchange path.

The lower end of the second header tank (4) is located below the upper end of the first header tank (3), and the second header tank (4) has a gas-liquid separation function.

Left and right end portions of the heat exchange tubes (2) which constitute the first heat exchange path (P1) are connected to the first header tank (3) and the third header tank (5), respectively, by means of brazing. Left and right end portions of the heat exchange tubes (2) which constitute the second heat exchange path (P2) are connected to the second header tank (4) and the third header tank (5), respectively, by means of brazing.

The first to third header tank (3) to (5) and the first and second heat exchange paths (P1) and (P2) form a condensation section (90A), which condenses refrigerant. The first and second heat exchange paths (P1) and (P2); i.e., all the heat exchange paths, serve as a refrigerant condensation path for condensing refrigerant.

A refrigerant inlet (91) is formed in a lower end portion of the first header tank (5), which constitutes the condensation section (90A), and a refrigerant outlet (92) is formed in a lower end portion of the second header tank (4). A refrigerant inlet member (not shown) communicating with the refrigerant inlet (91) is joined to the first header tank (3), and a refrigerant outlet member (not shown) communicating with the refrigerant outlet (92) is joined to the second header tank (4).

The remaining structure is similar to that of the condenser shown in FIGS. 1 to 3.

In the condenser (90) shown in FIG. 12, gas phase refrigerant of high temperature and high pressure compressed by the compressor flows into the first header tank (3) via the refrigerant inlet member and the refrigerant inlet (91). The gas phase refrigerant is condensed while flowing rightward within the heat exchange tubes (2) of the first heat exchange path (P1), and then flows into the third header tank (5). The refrigerant having flowed into the third header tank (5) is condensed while flowing leftward within the heat exchange tubes (2) of the second heat exchange path (P2), and then flows into the second header tank (4). The refrigerant having flowed into the second header tank (4) is gas-liquid mixed phase refrigerant. A portion of the gas-liquid mixed phase refrigerant; i.e., liquid-predominant mixed phase refrigerant, stays in a lower region within the second header tank (4) because of gravitational force, and flows out via the refrigerant outlet (92) and the refrigerant outlet member. The refrigerant is then fed to the evaporator via the expansion valve.

Meanwhile, the gas phase component of the gas-liquid mixed phase refrigerant having flowed into the second header tank (4) stays in an upper region within the second header tank (4).

In the condenser (90) shown in FIG. 12, between the first header tank (3) and the third header tank (5), two or more heat exchange paths each formed by a plurality of heat exchange tubes (2) successively arranged in the vertical direction may be provided such that they are juxtaposed in the vertical direction. In the case where an even number of heat exchange paths are provided between the first header tank (3) and the third header tank (5), a refrigerant inlet is formed in a lower end portion of the third header tank (5), and a proper number of header sections are provided in each of the first header tank (3) and the third header tank (5). In the case where an odd number of heat exchange paths are provided between the first header tank (3) and the third header tank (5), a refrigerant inlet is formed in a lower end portion of the first header tank (3), and a proper number of header sections are provided in each of the first header tank (3) and the third header tank (5).

Figure 13:
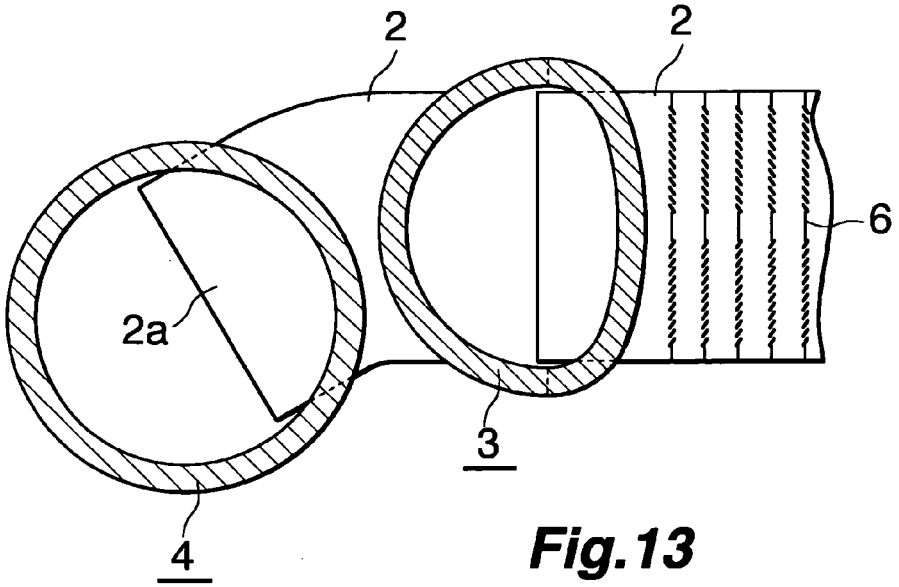
FIG. 13 is a sectional view corresponding to FIG. 2 and showing a modification of the condenser of the present invention concerning the second header tank and the heat exchange tubes.
Figure 14:
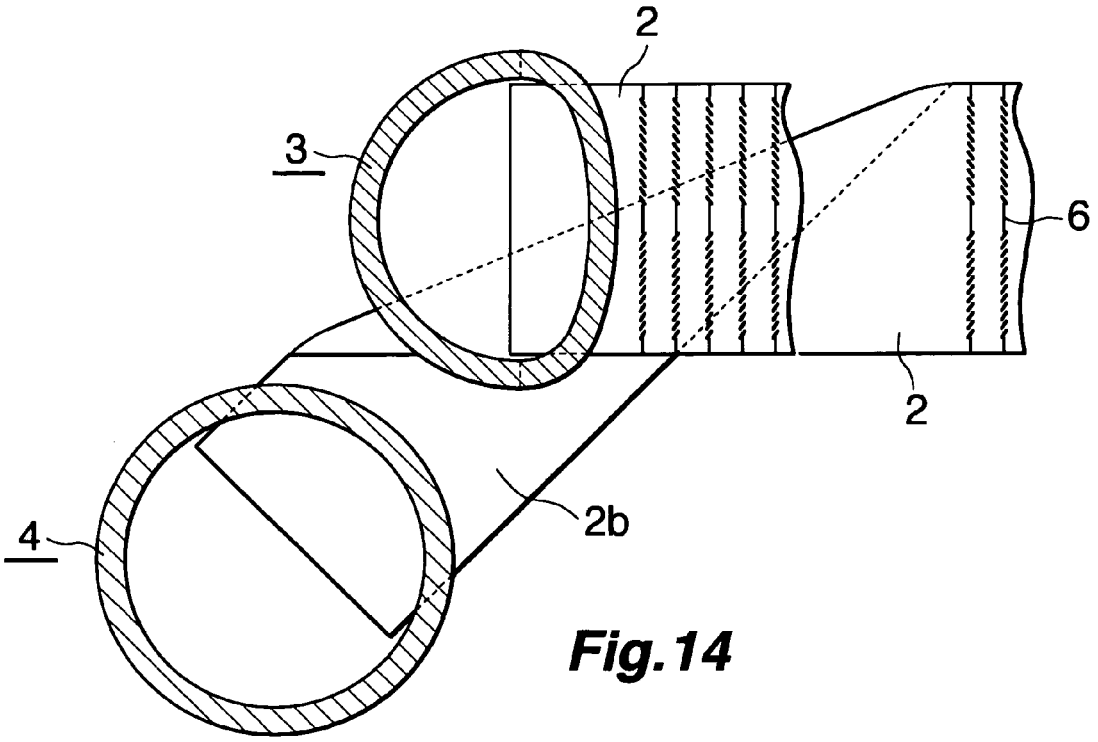
FIG. 14 is a sectional view corresponding to FIG. 2 and showing another modification of the condenser of the present invention concerning the second header tank and the heat exchange tubes.
Figure 15:
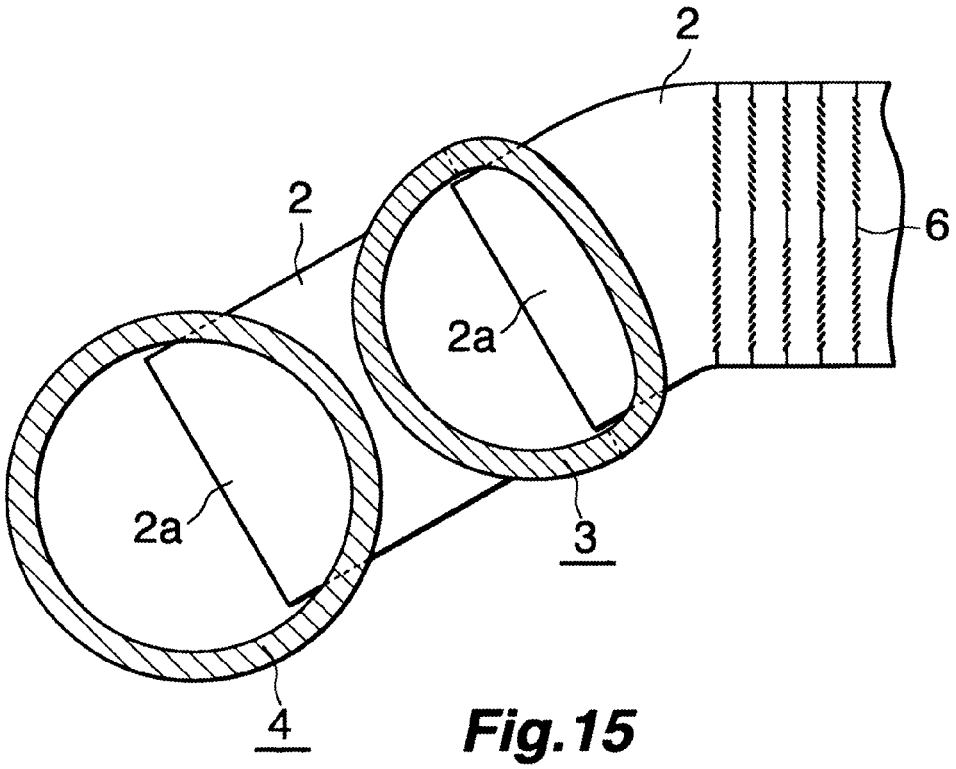
FIG. 15 is a sectional view corresponding to FIG. 2 and showing still another modification of the condenser of the present invention concerning the first header tank, the second header tank, and the heat exchange tubes.

FIGS. 13 to 15 show modifications regarding the position at which the second header tank of the condenser is provided.

In FIG. 13, the second header tank (4) is disposed leftward of and diagonally behind the first header tank (3). Left end portions of the heat exchange tubes (2) connected to the second header tank (4) are bent diagonally rearward. A bent portion (2*a*) of each bent heat exchange tube (2) is located in the same plane as the remaining unbent portion of the heat exchange tube (2).

In FIG. 14, the second header tank (4) is disposed leftward of and diagonally behind the first header tank (3). Left end portions of the heat exchange tubes (2) connected to the second header tank (4) are bent diagonally rearward and bent downward in a folded back shape. A bent portion (2*b*) of each bent heat exchange tube (2) is located in a plane different from a plane in which the remaining unbent portion of the heat exchange tube (2) is located.

In FIG. 15, left end portions of the heat exchange tubes (2) connected to the first header tank (3) and left end portions of the heat exchange tubes (2) connected to the second header tank (4) are bent diagonally rearward at the same angle. A bent portion (2*a*) of each bent heat exchange tube (2) is located in the same plane as the remaining unbent portion of the heat exchange tube (2). Furthermore, the first header tank (3) is disposed diagonally rearward of the center line (with respect to the width direction) of the unbent portion of each of the heat exchange tubes (2) connected to the first header tank (3). The second header tank (4) is disposed leftward of and diagonally behind the first header tank (3).

INDUSTRIAL APPLICABILITY

The condenser according to the present invention is suitably used in a car air conditioner mounted on an automobile.

The invention claimed is:

1. A condenser comprising:

a first header tank which is provided on one side of the condenser;

a second header tank provided on the one side of the condenser and having a gas-liquid separation function, an upper end of the second header tank being located above a lower end of the first header tank, a lower part of the second header tank being located below the lower end of the first header tank;

said second header tank comprising an upper part and the lower part, the upper part comprising a portion of the second header tank located higher than the lower end of the first header tank along a substantially vertical direction;

a gap between the upper part of the second header tank and the first header tank in a substantially horizontal direction;

a third header tank provided on another side of the condenser opposite to the one side;

a plurality of first heat exchange tubes extending in an extending direction between the first header tank and the third header tank to connect the first header tank and the third header tank;

the lower part of the second header tank being provided on a side opposite to the third header tank in the extending direction with respect to the first header tank;

a plurality of second heat exchange tubes provided to extend in the extending direction only between the lower part of the second header tank and the third header tank to connect the lower part of the second header tank and the third header tank, the plurality of second heat exchange tubes being brazed to the lower part of the second header tank, a length of the plurality of second heat exchange tubes between an outer surface of the second header tank and an outer surface of the third header tank in the extending direction being greater than a length of the plurality of first heat exchange tubes between an outer surface of the first header tank and the outer surface of the third header tank in the extending direction, the plurality of second heat exchange tubes being positioned downstream of the plurality of first heat exchange tubes with respect to a flow of refrigerant, wherein a gas-liquid mixed phase of the refrigerant enters the second header tank, the gas-liquid mixed phase is separated in the second header tank due to gravitational force into a gas phase component and a liquid-predominant mixed phase, and wherein the gas phase component stays in the upper part within the second header tank, while the liquid-predominant mixed phase stays in the lower part of the second header tank and then flows towards the third header tank, and wherein the first header tank includes an inlet configured to allow the refrigerant to enter the condenser from outside the condenser through the inlet of the first header tank.

2. The condenser according to claim 1, wherein the upper end of the second header tank is located below an upper end of the first header tank.

3. The condenser according to claim 2, wherein the inlet of the first header tank is located above the upper end of the second header tank.

4. A condenser comprising:

a first header tank which is provided on one side of the condenser along a substantially vertical direction;

a second header tank provided on the one side of the condenser along the substantially vertical direction and having a gas-liquid separation function, an upper end of the second header tank being located above a lower end of the first header tank, a lower part of the second header tank being located below the lower end of the first header tank;

said second header tank comprising an upper part and the lower part, the upper part comprising a portion of the second header tank located higher than the lower end of the first header tank along the substantially vertical direction;

a gap between the upper part of the second header tank and the first header tank in the substantially horizontal direction;

a third header tank provided along the substantially vertical direction on another side of the condenser opposite to the one side;

a plurality of first heat exchange tubes extending in a substantially horizontal direction between the first header tank and the third header tank to connect the first header tank and the third header tank;

the lower part of the second header tank being provided on a side opposite to the third header tank in the substantially horizontal direction with respect to the first header tank;

a plurality of second heat exchange tubes provided to extend in the substantially horizontal direction only between the lower part of the second header tank and the third header tank to connect the lower part of the second header tank and the third header tank, the plurality of second heat exchange tubes being brazed to the lower part of the second header tank, a length of the plurality of second heat exchange tubes between an outer surface of the second header tank and an outer surface of the third header tank in the substantially horizontal direction being greater than a length of the plurality of first heat exchange tubes between an outer surface of the first header tank and the outer surface of the third header tank in the substantially horizontal direction, the plurality of second heat exchange tubes being positioned downstream of the plurality of first heat exchange tubes with respect to a flow of refrigerant;

wherein a gas-liquid mixed phase of the refrigerant enters the second header tank, the gas-liquid mixed phase is separated in the second header tank due to gravitational force into a gas phase component and a liquid-predominant mixed phase, and wherein the gas phase component stays in the upper part within the second header tank, while the liquid-predominant mixed phase stays in the lower part of the second header tank and then flows towards the third header tank.

5. The condenser according to claim 4, wherein the second header tank is positionally shifted from the first header tank in an air-passing direction; second-header-tank-side end portions of the plurality of second heat exchange tubes connected to the second header tank are bent; and a bent portion of each bent heat exchange tube is located in the same plane as the remaining unbent portion of the heat exchange tube.

6. The condenser according to claim 4, wherein the second header tank is positionally shifted from the first header tank in an air-passing direction; second-header-tank-side end portions of the plurality of second heat exchange tubes connected to the second header tank are bent in a folded back shape; and a bent portion of each bent heat exchange tube is located in a plane shifted from a plane in which the remaining unbent portion of the heat exchange tube is located.

7. The condenser according to claim 4, wherein the second header tank is positionally shifted from the first header tank in an air-passing direction; first-header-tank-side end portions of the plurality of first heat exchange tubes connected to the first header tank and second-header-tank-side end portions of the plurality of second heat exchange tubes connected to the second header tank are bent; and a bent portion of each bent heat exchange tube is located in the same plane as the remaining unbent portion of the heat exchange tube.

8. The condenser according to claim 4, further comprising:

at least one of a desiccant, a gas-liquid separation member, and a filter which are disposed within the second header tank.

9. The condenser according to claim 4, wherein the plurality of first heat exchange tubes constitute at least one heat exchange path in which refrigerant flows in a same direction, and wherein the plurality of second heat exchange tubes constitute a plurality of heat exchange paths, refrigerant flows in a same direction in each of the plurality of heat exchange paths and refrigerant flows in an opposite direction in adjacent heat exchange paths among the plurality of heat exchange paths.

10. The condenser according to claim 9, wherein the at least one heat exchange path and an uppermost heat exchange path among the plurality of heat exchange paths, which is adjacent to the at least one heat exchange path, are configured to serve as a refrigerant condensation path to condense the refrigerant, and wherein the plurality of heat exchange paths other than the uppermost heat exchange path are configured to serve as a refrigerant super-cooling path to super-cool the refrigerant.

11. The condenser according to claim 4, wherein the first header tank is disposed between the second header tank and the third header tank in the extending direction.

12. The condenser according to claim 4, wherein the first header tank and the second header tank are positionally shifted from each other.

13. The condenser according to claim 4, wherein the refrigerant enters the condenser from outside the condenser when the refrigerant flows into the first header tank.

14. The condenser according to claim 4, wherein the refrigerant enters the condenser from outside the condenser when the refrigerant flows into the third header tank.

15. The condenser according to claim 4, wherein the first header tank includes an inlet configured to allow the refrigerant to enter the condenser from outside the condenser through the inlet of the first header tank.

16. The condenser according to claim 4, wherein the third header tank includes an inlet configured to allow the refrigerant to enter the condenser from outside the condenser through the inlet of the third header tank.

17. The condenser according to claim 4, wherein the upper end of the second header tank is located below an upper end of the first header tank.

* * * * *